United States Patent [19]

Dugan

[11] 4,428,801

[45] Jan. 31, 1984

[54] METHOD AND DEVICE FOR PROVIDING SHAPED ELECTROFORMED PARTS USING SHRINKABLE TUBE MEMBERS

[75] Inventor: William P. Dugan, Pomona, Calif.

[73] Assignee: General Dynamics, Pomona Division, Pomona, Calif.

[21] Appl. No.: 429,648

[22] Filed: Sep. 30, 1982

[51] Int. Cl.[3] ..... C25D 1/02; C25D 1/10

[52] U.S. Cl. ..... 204/9; 204/281

[58] Field of Search ..... 204/3, 4, 9, 281

[56] References Cited

U.S. PATENT DOCUMENTS

| | | | |
|---|---|---|---|
| 1,694,962 | 12/1928 | Berry | 204/9 |
| 3,464,898 | 9/1969 | Norris | 204/9 |
| 3,763,030 | 10/1973 | Zimmer | 204/281 |
| 3,876,264 | 2/1975 | Carson | 204/4 |
| 3,947,348 | 3/1976 | Schabernack et al. | 204/9 |
| 4,276,148 | 6/1981 | Otthofer, Jr. | 204/281 |
| 4,326,928 | 4/1982 | Dugan | 204/9 |

FOREIGN PATENT DOCUMENTS

| | | | |
|---|---|---|---|
| 4459 | of 1885 | United Kingdom | 204/9 |

OTHER PUBLICATIONS

ELECTRONICS, Sep. 11, 1959, pp. 114–117, Electroforming of Intricate Electronic Components by Edward B. Murphy.

*Primary Examiner*—T. M. Tufariello

*Attorney, Agent, or Firm*—Henry M. Bissell; Edward B. Johnson

[57] ABSTRACT

An electroforming process in which parts of complex configurations can be formed more effectively than with the processes available in the prior art. In particular, a heat shrinkable tube is positioned on a mandrel, the mandrel being of a shape different from the ultimate part to be formed but which will develop the desired shape for the part when shrink tubing is shrunk onto the mandrel. A layer of metal is then deposited over the tube and the mandrel is then removed. The tube is heated again, shrinking to a smaller size which enables it to be removed from the finished part.

16 Claims, 9 Drawing Figures

METHOD AND DEVICE FOR PROVIDING SHAPED ELECTROFORMED PARTS USING SHRINKABLE TUBE MEMBERS

BACKGROUND OF THE INVENTION

1. Field of the Invention

This invention relates to electroforming and, more particularly, to a method of providing shaped electroformed parts utilizing a shrink tube initially positioned about a mandrel.

2. Description of the Prior Art

Electroforming is a process by which metal parts can be made accurately by electrochemical deposition of metal onto a mandrel. It allows parts that are relatively difficult or costly to make by standard machine shop practices to be produced economically. This plating technique provides close control of tolerances of intricate shapes and can produce smoother interior finishes of high quality.

The electroforming process has been available for many years and in general comprises four basic steps: preparation of the electroplating bath, preparation of the mandrel and its placement in the electrochemical bath, the subsequent metal buildup, and the removal of the component from the mandrel without damaging the shell of the deposited metal. Over the years, many techniques have been provided which improve on these basic steps. Examples of prior art electroforming techniques can be found in the following patents.

British Pat. No. 4499, published in 1885, describes a technique wherein the surfaces of cores are prepared to receive an electrodeposit of copper, the cores then being mounted in a depositing tank and the electrodeposition process initiated until a cylinder of deposited metal is obtained upon the core. When the deposited cylinder develops to the requisite thickness, the core with its electrodeposited cylinder is removed from the bath and cooled down, whereupon shrinkage of the core takes place and the deposited cylinder is freed from the core.

U.S. Pat. No. 1,694,962 discloses a technique for forming a layer of copper, for example, on a mandrel having a conductive layer thereon. The technique for removing the mandrel after the metal is also disclosed.

U.S. Pat. No. 3,464,898 discloses an electroforming process wherein complex hollow metal articles are formed, a conductive material being deposited on the surface of a plastic foam mandrel, a layer of metal thereafter being electrodeposited onto the conductive material and the mandrel then being separated from the metal article thus formed.

U.S. Pat. No. 3,763,030 discloses a technique for making seamless hollow cylinders by forming a cylindrical metal film on an expandable and contractable, hollow, cylindrical, rotary matrix.

U.S. Pat. No. 3,867,264 discloses an electroforming process wherein the surface contour of a master form is duplicated, a polymeric material first being applied to a master. The layer is then dried to provide a polymer layer, metal is electrolessly plated onto the polymer, metal is then electroplated to the desired thickness on the electroless plated metal layer, and thereafter the plated metal is removed from the master.

U.S. Pat. No. 3,947,348 describes a process of making a waveguide wherein copper is electrolytically deposited on a nickel steel mandrel. After plating, the assembly is heated so that the formed copper tube separates from the mandrel without sticking and thus can be taken off without exercise of undue force which would otherwise damage the mandrel or the tube.

U.S. Pat. No. 4,276,148 describes a method of making seamless hollow cylinders by electrolytically forming cylinders on a expandable and contractable mandrel. The mandrel has an inflatable outer surface or jacket which permits it to be expanded or contracted for holding or removing the electroformed cylinder therefrom.

In my prior U.S. Pat. No. 4,326,928 I disclose a method of electroforming a part wherein a metal layer is electrolessly deposited on a mandrel of heat shrinkable material, a second lyer of material is then electrodeposited over the first layer, the resultant assembly is then heated to a temperature which will shrink the mandrel, and the shrunken mandrel is removed from the electroformed part.

Additional background regarding the electroforming art is disclosed in an article entitled "Electroforming of Intricate Electronic Components", *Electronics,* Sept. 11, 1959, pages 114–117.

For the most part, the aforementioned electroforming processes were directed to the formation of cylindrical tubing. When parts of complex configurations are to be fabricated, the mandrels associated with such a process are usually shaped to the configuration of the part to be formed. In this situation, a method for removing the mandrel from the finished part must be provided. FIG. 8 of my aforementioned U.S. Pat. No. 4,326,528 illustrates an electroformed channel-shaped part, the shrunken mandrel inside the finished part being accessible for removal from the end of the part.

In order to make complex electroformed parts in accordance with prior art techniques, the mandrel was configured to the shape of the part as set forth hereinabove. Thus the fabrication of the mandrel itself is quite complex and costly. It is also difficult in prior art processes to metalize the inside wall of a formed part, since the mandrel is normally removed only after the part itself is removed from the plating bath.

Thus what is desired is a new electroforming process which is particularly adapted for forming parts of complex configuration, is less costly and is simpler than prior art processes and which also allows the inner wall of the formed part to be metalized while in the plating bath.

SUMMARY OF THE INVENTION

In brief, arrangements in accordance with the present invention comprise an electroforming process in which parts of complex configuration can be formed less expensively than with the processes available in the prior art. In particular, a heat shrinkable tube is placed about a mandrel, the mandrel being of a size and shape such that the tube is deformed to the configuration desired when it shrinks and contacts the mandrel after being heated. A layer of metal is then deposited on the tube and the mandrel is then removed. The tube is heated again, shrinking to a smaller size which enables it to be removed from the finished part. The mandrel is coated with a release material or, in an alternative embodiment, is constructed of Teflon to enhance mandrel separation.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

As set forth hereinabove, electroforming is a desirable process for making a part since the thickness of a part can be carefully controlled and a smooth finish provided. It is to be understood that, although a rectangular shaped part is illustrated as being formed by the process of the present invention, parts of various other configurations can also be shaped.

Figure 1:
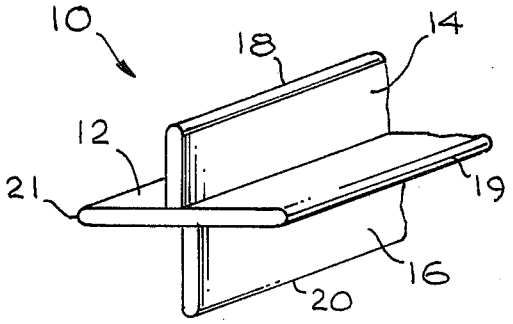
FIG. 1 illustrates a mandrel which may be utilized in the present invention.

FIG. 1 illustrates a shaped mandrel 10 which can comprise metal, such as stainless steel or aluminum, having a release material layer such as wax or graphite coated thereon, or a plastic, such as Teflon to enhance mandrel separation. (Teflon is a registered trademark of E. I. duPont de Nemours & Co. for synthetic resin polymers and products.) As shown in the figure, the mandrel 10 comprises an elongated rectangular shaped member 12 and elongated, rectangular shaped members 14 and 16, members 14 and 16 being joined to opposite surfaces of member 12 as shown to develop a general cruciform cross-section. The edges of members 14 and 16 are rounded to provide for a better shrinkage fit. The shape and size of mandrel 10 are selected such that a rectangular shaped finished part may be provided by the process of the present invention. It should be noted however, that mandrels of other shapes and sizes can be designed which will result in the formation of finished parts having different complex configurations when used with shrink tubing in the method of the present invention.

Figure 2:
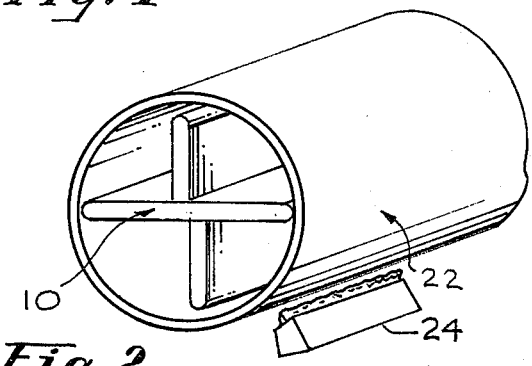
FIG. 2 illustrates a step in the process of the present invention after the mandrel has been inserted inside a heat shrinkable metal tube member.
Figure 6:
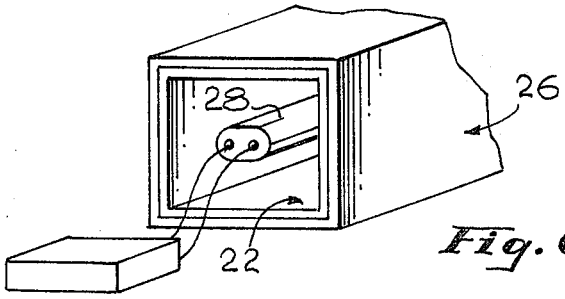
FIG. 6 illustrates the rectangular shaped part overlying the deformed tube member.
Figure 3:
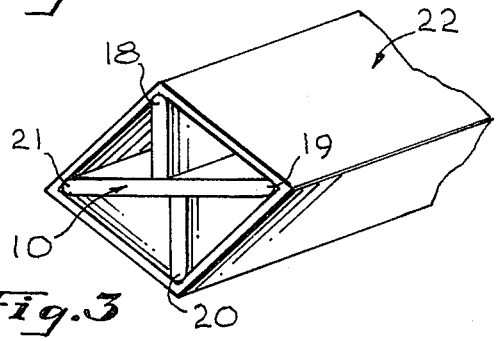
FIG. 3 illustrates a step in the process of the present invention after the heat shrinkable tube member has been restrictively shrunk around the edges of the mandrel.

FIG. 2 illustrates the completion of the first step in the process of the present invention wherein mandrel 10 has been inserted within a tubular heat shrinkable member 22. Heat shrinkable materials are known in the art and a polyolefin such as polyethylene or polypropylene works well for this purpose. The heat shrinkable materials have the capacity to accept a metal layer and the property of shrinking when heat is applied thereto. After the mandrel 10 is positioned within the tubular member 22 (a tight fit is desirable to reduce the restrictive shrinking distance), the tubular member 22 is heated as demonstrated graphically by the heat source 24. Upon the application of heat, the tubular member 22 shrinks from its original dimensions. The heat shrinkable material changes dimensions drastically and ultimate shrinkage could be on the order of 50%. As shown in FIG. 3, the tubular member 22 has shrunk about the mandrel 10 in a manner such that it conforms to the shape of mandrel 10 but has not yet shrunk to its limit, a step known as restrictive shrinking. Actually, tubular member 22 conforms to a shape defined by the mandrel edges 18, 19, 20 and 21 (FIG. 1).

Figure 5:
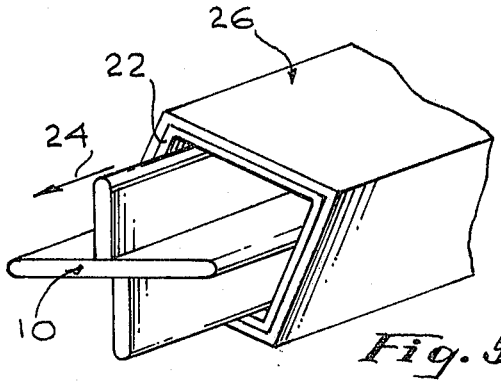
FIG. 5 shows the mandrel being removed from the deformed tube member.
Figure 4:
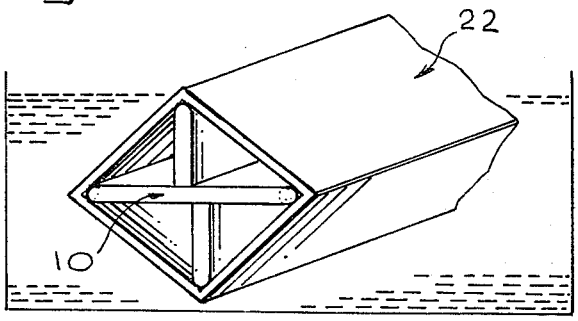
FIG. 4 illustrates a step of applying an electroless base layer on the surface of the deformed tube member.

The heat shrinkable tubular member 22 with the mandrel 10 therein is then subjected to an electroless coating process as shown in FIG. 4 of the drawing. The figure demonstrates that the heat shrinkable material 22 as being immersed in a bath of electroless copper electrolyte. Other suitable deposition processes may be used. The polyolefin which has been used for the heat shrinkable material 22 provides a good base for electroless deposition. It should be noted that member 22 can be metalized by deposition techniques involving a catalytic reduction of the desired metal or metal alloys from a chemical plating solution to form a metal layer. Electroless deposition solutions of nickel, cobalt, copper, alloys such as nickel-iron, nickel-cobalt and nickel-tungsten-phosphorous, and the like, are well known. An additional layer is then deposited by electroplating on the electroless metal layer. For example, the electroless metal layer can be deposited to a desired thickness and then additional layers of suitable metal, such as copper, can be electroplated thereon. Next, the mandrel 10 is physically removed from the member 22 in the direction of arrow 24 as shown in FIG. 5. The external surface of material 22 has not been plated with a copper layer 26 (actually two copper layers).

Figure 7:
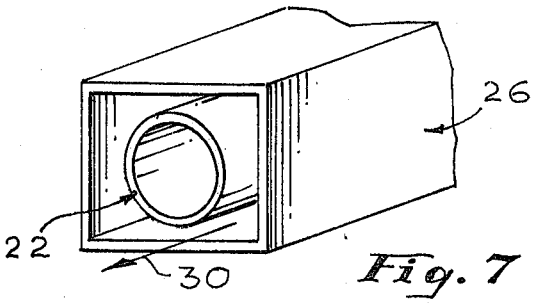
FIG. 7 illustrates the heat shrinkable tube member as further shrunk when heat is applied in a second step to allow removal of the tube member from the finished part.
Figure 8:
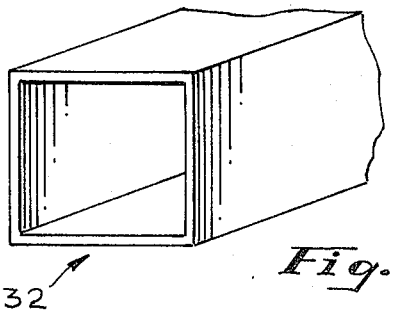
FIG. 8 is a partial view of the final product part formed in accordance with the teachings of the present invention.

In order to remove the member 22 from the layer 26 to form the finished part, a radiant heating element 28 is placed within tubular member 22 and positioned to uniformly heat the interior surface thereof. When the temperature reaches the point required for the particular heat shrinkable material involved, the material 22 shrinks further from the dimension and shape developed in the restrictive shrinking step and back to the tubular configuration as shown in FIG. 7. Due to the reduction in size, the member 22 is easily removed from the finished part in the direction of arrow 30 as shown, resulting in the finished part 32, a rectangular copper tube, shown in FIG. 8.

Figure 9:
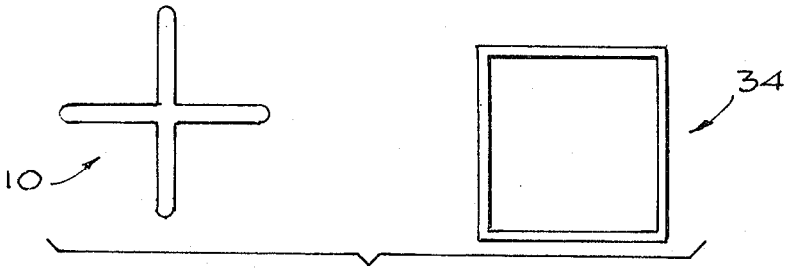
FIG. 9 illustrates in a simplified manner how the process of the present invention is more cost effective in forming parts of complex configuration when compared to prior art techniques.

FIG. 9 illustrates in a simplified manner the cost effectiveness of the present invention compared to prior art electroforming processes. A comparison of the end views of mandrel 10 and mandrel 34 which would be required to form a rectangular tube part with the process of the present invention and with prior art processes, respectively, shows that the former requires substantially less material than the latter for almost all practical situations. More important, however, is the greatest ease of removal of the mandrel 10 and associated tube member from the finished part as contrasted with the mandrel 34 for forming the same part by prior techniques.

Although there have been described above specific arrangements of a process for providing an electroformed product in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. The method of electroforming a metal part comprising the steps of:

providing a mandrel of a particular size and shape which will develop a desired size and contour for forming the part when a shrinkable member is shrunk onto the mandrel;

applying heat to said member whereby said member shrinks into a tensioned contour established by the mandrel shape;

depositing a metallic layer on said member to form a part;

removing the mandrel from within the member;

applying heat to said member to develop further shrinkage of the member away from the deposited layer; and removing the shrunken member from said part.

2. The method of claim 1 wherein said mandrel is physically removed from the member during the removing step.

3. The method of claim 1 wherein said mandrel is shaped to cause the shrunken member to provide the complex configuration of the part to be formed.

4. The method of claim 3 wherein the mandrel is shaped such that the metallic part formed on the shrunken member is a rectangular tubular member.

5. The method of claim 1 wherein said mandrel is constructed of Teflon.

6. The method of claim 1 wherein said surface of said mandrel is coated with a release material.

7. The method of claim 6 wherein said mandrel is constructed of stainless steel.

8. The method of claim 1 wherein the shape of the mandrel is materially different from the shape of the part being electroformed.

9. The method of claim 8 wherein the mandrel is cruciform in cross-section and the part is square in cross-section and is hollow.

10. The method of claim 8 wherein the mandrel is cruciform in cross-section and the part is rectangular in cross-section and is hollow.

11. Apparatus for use in electroforming a hollow, generally square-cornered part comprising:

a mandrel of generally cruciform shape; and a shrinkable tube member shrunk onto the mandrel by restrictive shrinking and maintained in tension by contact at the projecting edges of the mandrel.

12. The device of claim 11 wherein the mandrel is removable from within the shrinkable tube member.

13. The device of claim 12 wherein the shrinkable tube member is further shrinkable by the application of heat after the mandrel is removed.

14. A device for use in an electroforming process to develop a hollow part having a plurality of interior corners and a plurality of generally planar faces intersecting at said corners, the device comprising:

a three-dimensional mandrel having a plurality of projecting edges situated to correspond to the interior corners of the finished part; and a shrinkable tube member partially shrunken onto the mandrel to define a plurality of generally planar faces extending in tension between adjacent projecting edges of the mandrel.

15. The device of claim 14 wherein the mandrel is removable from the tube member.

16. The device of claim 15 wherein the tube member is shrinkable to a lesser cross-sectional dimension after the mandrel is removed therefrom.

* * * * *